United States Patent [19]

Mette

[11] 4,159,726

[45] Jul. 3, 1979

[54] LIQUID FILLING DEVICE WITH AUTOMATIC SHUT-OFF SENSOR

[75] Inventor: Manfred Mette, Hamburg, Fed. Rep. of Germany

[73] Assignee: Ortmann & Herbst GmbH, Hamburg, Fed. Rep. of Germany

[21] Appl. No.: 853,244

[22] Filed: Nov. 21, 1977

[30] Foreign Application Priority Data

Nov. 24, 1976 [DE] Fed. Rep. of Germany ..... 2653246

[51] Int. Cl.[2] ..... B65B 3/26; B65B 31/00

[52] U.S. Cl. ..... 141/40; 137/199; 141/198; 141/302

[58] Field of Search ..... 137/202, 199, 588; 141/39, 40, 46, 198, 212, 213, 216, 220, 229, 285, 286, 301, 302, 308, 303

[56] References Cited

U.S. PATENT DOCUMENTS 1,036,478 8/1912 Fisher ..... 141/303 X

FOREIGN PATENT DOCUMENTS 405385 2/1934 United Kingdom ..... 137/202

*Primary Examiner*—Richard E. Aegerter
*Assistant Examiner*—Frederick R. Schmidt
*Attorney, Agent, or Firm*—James R. Cypher

[57] ABSTRACT

A liquid level sensor for use with a container filling device, in particular jars, which includes a dispensing tube from which the liquid falls downward and outward in a paraboloid bell-shaped stream, and which has a return air pipe and a ball valve sensor to stop filling when liquid droplets coat said ball. The air pipe and sensor are both located in the space enclosed by the bell-shaped stream. A sealing device contacts the jar rim during filling.

7 Claims, 2 Drawing Figures

LIQUID FILLING DEVICE WITH AUTOMATIC SHUT-OFF SENSOR

BACKGROUND OF THE INVENTION

This invention relates to automatic liquid level sensors for container filling devices which are used primarily in the beverage bottling industry for filling containers having a neck diameter only a little smaller in diameter than the container proper, such as jars. In contrast to the case of filling bottles, in which the liquid is directed along the wall of the bottle from the moment it enters the bottle, it is necessary when filling wide mouthed containers to find another way to guide the liquid from the relatively narrow discharge opening of the filling device to the much larger diameter wall of the container.

With filling devices for jars this is accomplished by producing a freely falling bell-shaped stream, which spreads out parabolically from the discharge opening to the container wall. The outwardly directed radial component of the flow is produced either through rotational momentum induced by a spiral mechanism or by using a centrally positioned, outwardly directed deflector, which may, for example, be located on the return air pipe.

Prior art sensors usually have the form of a float gauge, in which a buoyant ball rises with the level of liquid and is pressed against the lower opening of the return air pipe, sealing it off. This interruption of the return air flow halts the filling process. In consequence, the sensor is always located at the maximum fill level.

This location of the sensor at the maximum fill level is a disadvantage of the usual designs. Since the sensor always lies below the filling device, it necessarily extend past it and is exposed to damage when the containers under the device are moved in and out of position.

In addition, the usual sensor arrangement requires a complicated construction of the filling device. One familiar design provides a lifting mechanism for the container, which lowers the container when it is to be moved aside. Another familiar design has the container move only horizontally, the sealing ring being provided with a lifting mechanism. The sensor must also be raised in this version, usually by means of an arm connecting the sensor to the sealing ring. However, this increases unnecessarily the displacement of the sealing ring. In addition, the arm, which follows an essentially radial path through the bell-shaped stream, disrupts the flow of liquid; this is a disadvantage, especially in the case of carbonated beverages.

SUMMARY OF THE INVENTION

The gist of the present invention is a ball valve in which the ball, when dry, is normally suspended by air currents below the valve seat, but when the ball is coated with a thin film of liquid it seals with the valve sidewalls and is drawn up by suction force into sealing engagement with the valve seat.

Accordingly, an object of the present invention is to create a liquid filling device which will simplify movement of the containers in and out of the filling position yet is simple in construction and trouble-free in design.

The invention includes means for attaining an airtight seal of an outer area bounded by the bell-shaped stream and the container. A sensor designed to react to small quantities of liquid, for example liquid droplets, stricking it from any side, is located within the familiar bell-shaped stream. As the level of liquid in the container rises, pressure gradually develops on the bell-shaped stream, in essence because the air pressure in the inner area is kept constant by the return air pipe, while the pressure in the outer area is increased by the level of liquid rising into the space. At a pre-selected level which can be reproduced with surprising precision, the bell-shaped stream collapses and liquid is taken into the sensor, for example by splashing, so that the sensor stops the filling process. The exact location of the sensor is here largely up to the designer. He can locate the sensor far above the rim of the container, advantageously above the lower edge of the filling device, and thus protect it from contact with the containers being filled. Thus, for the first time a filling device has been created which requires no special care to protect the sensor when containers are moved into and out of filling position. The distance which the container or the sealing ring must be moved is considerably reduced. The sensor can be permanently mounted in position, so that parts which would otherwise be necessary to move it can be dispensed with, especially the arm running radially from the sealing ring to the sensor. Therefore the bell-shaped stream forms without disruption, making for an extremely smooth filling operation.

The sensor in the filling device of the invention has the advantage that it consists of a ball valve. The ball valve has an essentially cylindrical enclosed chamber, provided with openings at an upper and lower location and a ball enclosed in the chamber. The ball is greater in diameter than the opening to the return air pipe and slightly smaller than the cylinder in which it is located. When dry, this valve permits essentially free passage of air flowing from the container, and it closes only when liquid enters through the openings and by coating the outer surface of the ball or the inner surfaces of the cylinder causes the ball to form an air tight seal with the sidewalls of the cylinder and be sucked or pressed against the opening to the return air pipe. The force which raises the ball does not derive from the rise of the liquid level, as with the familiar designs, but rather from the return air flowing through the valve. Only a few droplets of liquid are needed to enter the sensor and cause the seal to form between the surface of the ball and the cylindrical wall.

BRIEF DESCRIPTION OF THE DRAWING

The figures illustrate a schematic example of the invention.

DESCRIPTION OF THE INVENTION

Figure 1:
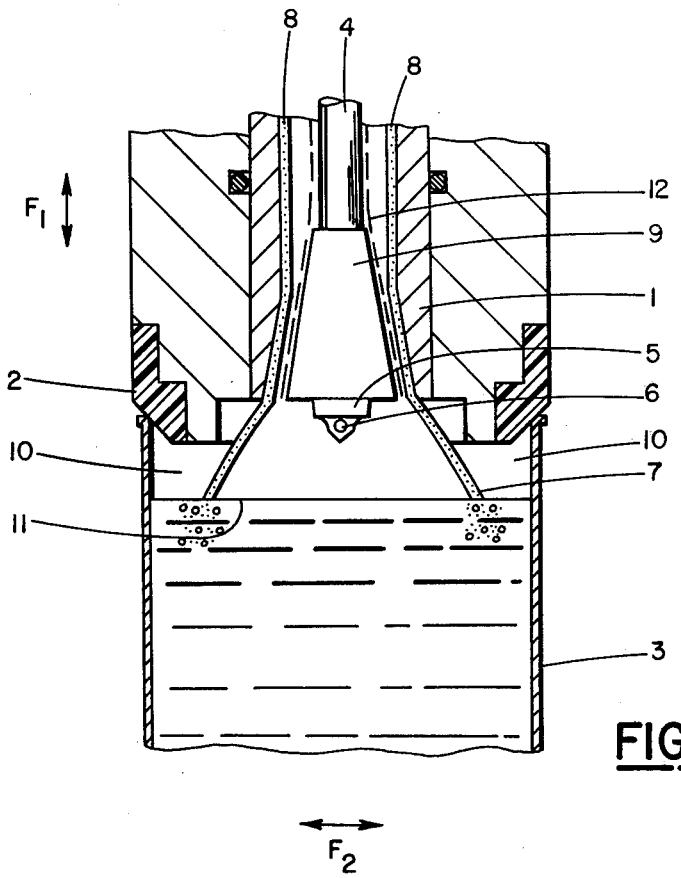
FIG. 1 shows a section through a jar filling device with a ball valve sensor.

As is clear from FIG. 1, the jar filling device represented has a dispensing tube 1. A sealing ring 2 is located on the outer wall of the dispensing tube. The sealing ring 2 is vertically adjustable in the direction of the arrow F1. The lifting mechanism for the sealing ring 2 is, for the sake of simplicity, not illustrated in the figure.

A jar 3 is moved toward the filling device horizontally in the direction of the arrow F2 and centered under it. Then, the sealing ring 2 which has just been raised a few millimeters, is lowered, so that its lower edge makes an airtight seal with the jar.

A fluid valve is provided inside the dispensing tube 1, above the area illustrated; this valve is not illustrated in order to simplify the drawing. A return air pipe 4 runs concentrically down the inside of the dispensing tube 1. A sensor 5 is located at its lower end, somewhat above the lower end of the discharge tube 1. The sensor includes a valve which closes the return air pipe; the valve and the sensor are designed as a unit in the example illustrated. By way of further example, an electronic control element which is sensitive to fluid and which controls an electric valve which closes off the return air pipe 4 can be used to activate the fluid valve.

The liquid falls freely from the dispensing tube in a bell-shaped stream pattern which spreads out parabolically as it falls, until the stream strikes the container wall, as illustrated in FIG. 1.

The method used with most familiar filling devices, consists in giving the downward flowing liquid a spiral rotational momentum so that the centrifugal force imparted to the liquid causes the liquid to flow down the inside face of the outer dispensing tube wall, leaving the center of the tube open. The liquid flowing on the dispensing tube wall is characterized by the number 8 illustrated in FIG. 1. After leaving the lower edge of the dispensing tube 1, the liquid then forms the desired bell-shaped stream.

Another method that has been developed for causing the liquid to flow against the wall of the container consists in directing the liquid which is flowing down the inside of the tube radially outward by means of a deflector 9 provided in the dispensing tube, so that the liquid follows approximately the dotted line 12 and also forms the desired bell-shaped stream 7.

In both cases the sensor 5 positioned inside the bell-shaped stream is free from liquid and liquid droplets during the filling operation, so that the sensor is not activated and the return air pipe 4 remains open. During the filling process, all of the air except for a small portion in an outer area 10 is displaced by the liquid in the container and flows upward through the return air pipe 4 into the upper chamber of the filling device, not illustrated.

A pocket of air in an outer area 10 is trapped by the formation of the bell-shaped stream 7. The pocket of air in outer area 10 is formed between the wall of the jar, the parts of the filling device and the bell-shaped stream. In the example illustrated this outer area 10 is sealed airtight by the sealing surface of the sealing ring 2 and the lower edge of the dispensing tube 1. As the level of liquid in the container rises, liquid moves into this outer area 10, as illustrated in FIG. 1. The outer area 10 is then decreased in volume, so that the gas pressure in its rises, until finally at a certain level—for example, the maximum fill level 11 illustrated in the figure—the bell-shaped stream 7 collapses. The liquid now flows down the dispensing tube 1 and into the container in a turbulent uncontrolled fashion and wets the sensor 5 by spattering. Liquid droplets enter holes 6 and coat the inside walls of the cylinder 13 and the surface of ball 14 with a film of liquid so that a temporary seal is formed between the outer surface of the ball 14 and walls 13. Since air can no longer flow through the holes 6 below the ball 14 and past the ball, the air still flowing through the holes 6 above the ball sucks the ball upwardly until the ball seats on the end 15 of pipe 4 and closes the return air pipe 4. By closing the air pipe 4 the only air outlet from the container is closed and thereby filling of liquid is stopped.

The maximum fill level 11 or the point in time when filling is to stop can be determined in advance, e.g. by appropriate alteration of the outer area 10. Experiments have shown that the desired maximum fill level 11 is reproduced with extreme accuracy.

Figure 2:
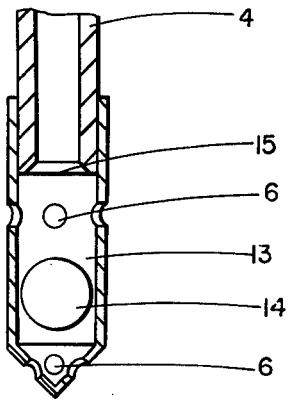
FIG. 2 shows an enlarged section through the ball valve represented in FIG. 1.

In the example illustrated in FIG. 2, the sensor 5, consists of a ball valve positioned at the lower end of the return air pipe 4. This ball valve has inside it a cylindrical chamber 13, in which a ball 14 of somewhat smaller diameter moves up and down. The ball and walls of chamber 13 are dimensioned so that air can pass around ball 14 when the ball and walls are dry, but air cannot pass around the ball if a thin film of water forms between the ball and the walls of chamber 13. In the upper and lower parts of the cylindrical chamber 13, holes 6 are provided in its wall, through which the return air enters before escaping from the cylindrical chamber 13 through the opening 15 in the end of the return air pipe 4.

The weight of the ball is carefully selected so that during the filling operation the ball 14 is kept in the floating position illustrated in FIG. 2, since the air entering above raises it by sucking and the air entering below the ball pushes on it. Air entering below the ball passes upwardly around the ball and into return air pipe 4. This balance is not disturbed until the ball and chamber walls become coated with liquid, which is sucked in through the holes 6. Even the smallest amounts of liquid, just a few drops, are sufficient to coat the ball and walls and cause a temporary seal. Ball 14 is pulled up rapidly by the continuing air flow through the upper holes 6 into the return air tube and the inertia of the ball carries it upwardly against opening 15 past upper holes 6, the ball 14 seals against opening 15 and stops the flow of air and consequently the flow of liquid.

I claim:

1. A device for filling liquid containers and having a housing with a lower edge and including a valve for automatically shutting off the flow of liquid into said containers at a pre-selected level comprising:

a. a sealing means (2) mounted on said lower edge of said housing engaging the outer edge of said container with an airtight seal;

b. a dispensing tube (1) mounted in said housing and connected to said valve, having means by which the liquid falls freely downwardly and outwardly in a paraboloid bell-shaped stream into said containers;

c. a return air pipe (4) having an opening (15) mounted within said dispensing tube;

d. sensor means mounted on said housing and located in the space enclosed by said bell-shaped stream and activated by the presence of liquid droplets;

e. signal carrying means operatively connecting said sensor means and said valve for shutting off the liquid flow to said containers before said pre-selected level reaches said sensor means; and f. said bell-shaped stream (7) forms a pocket of trapped air in an outer area (10) which is enclosed and sealed airtight between said bell-shaped stream (7) said container (3) said sealing means (2) and dispensing tube (1) until the rising liquid in said container causes said bell-shaped stream to collapse and to spatter liquid droplets onto said sensor when said liquid reaches a predetermined level below said sensor, thereby activating said sensor and terminating the filling of said container.

2. A liquid filling device as described in claim 1 comprising:

a. said sensor is located above said lower edge of said filling device.

3. A liquid filling device as described in claim 1 wherein said sensor means comprises:

a. a cylindrical chamber (13) mounted on the end of said return air pipe and is formed with openings (6) at upper and lower levels;

b. a weighted ball (14) mounted for unrestricted movement within said chamber when air only enters said upper and lower level openings (6);

c. said ball having a diameter greater than the diameter of said opening (15) and smaller than said diameter of said chamber;

d. said ball has a dimension so as to permit passage of air between said ball and chamber wall when air only enters said openings 6; and e. said ball and said chamber walls are so closely dimensioned as to seal and prevent passage of air therebetween when liquid droplets enter said openings 15 and a film of liquid forms between said ball and said chamber thereby causing said ball to be sucked upwardly by air passing through said upper level holes into said return air pipe and a to seal against opening (15) resulting in the shut-off of liquid to said container.

4. A device for filling liquid containers including a valve for automatically shutting off the flow of liquid into said containers comprising:

a. a sealing means (2) mounted on said device engaging the outer edge of said container with an airtight seal.

b. a dispensing tube (1) connected to said valve, having means by which the liquid falls freely downwardly and outwardly in a paraboloid bell-shaped stream into said container;

c. a return air pipe (4) having an opening (15) mounted within said dispensing tube;

d. sensor means located in the space enclosed by said bell-shaped stream and activated by the presence of liquid droplets caused by the rupturing of said bell-shaped stream which spatters liquid droplets onto said sensor, when said liquid reaches a predetermined level below said sensor means; and e. signal carrying means operatively connecting said sensor means and said valve for shutting off the liquid flow to said containers.

5. A device for filling containers as described in claim 4 comprising:

a. said sensor means includes a chamber formed with openings for alternately receiving air and liquid droplets therethrough, and said chamber is located at the approximate same elevation as said sealing means.

6. A device as described in claim 5 comprising:

a. said chamber is located so that its lowermost portion is located above the lowermost portion of said sealing means.

7. A device as described in claim 6 comprising:

a. said signal means consists of the shutoff of air entering and traveling through said return air pipe 4.

* * * * *